US005971406A

United States Patent [19]

Lyman

[11] Patent Number: 5,971,406

[45] Date of Patent: Oct. 26, 1999

[54] FOOT SUPPORTING SKATE

[76] Inventor: Shawn R. Lyman, 20515 SW. Edy Rd., Sherwood, Oreg. 97140

[21] Appl. No.: 08/305,454

[22] Filed: Sep. 13, 1994

[51] Int. Cl.[6] ..... A63C 17/00

[52] U.S. Cl. ..... 280/11.22; 280/809

[58] Field of Search ..... 280/11.19, 11.22, 280/11.27, 11.28, 809, 87.041, 87.042, 87.043, 291

[56] References Cited

U.S. PATENT DOCUMENTS

| | | | |
|---|---|---|---|
| 5,090,716 | 2/1992 | Borden | 280/87.043 |
| 5,427,391 | 6/1995 | Cooper | 280/809 |
| 5,478,094 | 12/1995 | Pennestri | 280/11.22 |

OTHER PUBLICATIONS

Bregonian Article, Thursday Oct. 13, 1994, pp. 1, 6, 7, Northwest Outdoors, Author: Terry Richard, Photographer: Angela Cara Pancrazio.

Oregonian Article, Thursday Aug. 19, 1993, pp. 1, 2, 6, Northwest Outdoors Section, Author: Terry Richard, Photographer: Shane Young.

The Oregonian, Thursday Oct. 13, 1994, pp. 1, 6, & 7, Author Terry Richard, Article Title: Weird Gear.

*Primary Examiner*—Richard M. Camby
*Attorney, Agent, or Firm*—Howard Russell

[57] ABSTRACT

Embodiments of a foot supporting skate device for supporting one's foot adjacent a roller skate, preferably but not limited to the in-line type, while skating according to a new method, the device comprising a foot support member integral with a pair of perpendicularly extending flanges having holes or slots therein for attaching the device to the roller skate preferably with a plurality of the skate's axle bolts and nuts.

8 Claims, 4 Drawing Sheets

FOOT SUPPORTING SKATE

BACKGROUND OF THE INVENTION

This invention relates to wheeled skating devices and more particularly to skates having a boot, shoe or other means attached to the skate's wheels for holding a rider's foot in position relative to the wheels.

Skates, including in-line roller skates and more conventional roller skates, wherein each skate has a boot or shoe for retaining the rider's foot in position relative to the skate's wheels, are well known in the art. Likewise, conventional skateboards having no such foot retaining means are also well known.

These prior art skating devices have posed limitations and relative hazards in certain circumstances and when attempting certain maneuvers. For example, when skating on a wet or otherwise moderately slippery surface, the use of conventional or in-line skates, wherein both of the rider's feet are booted, that is, retained in position relative to the wheels of the skates, has posed a problem in that upon sliding and losing his or her balance, the rider has attempted to recover on one or both of his or her feet, both of which have been essentially wheeled and more prone to slippage. This has limited the rider's ability to effectively recover. Also, under such slippery conditions, it has been more difficult for a rider to impel himself or herself forward when the rider's foot has been used to push off the ground with a wheeled skate prone to slippage.

Many prior art in-line skates have a brake attached to the skate near the heel of the skate boot. A recent attempt to remove one skate for increased stability and traction under slippery conditions has been made with an attempt to rest the non-skated foot on the prior art skate's brake while skating. However, this has proven problematic, since there has not been provided adequate support for the nonskated foot on the brake, because the brake has not been designed to support one's foot during skating or while attempting skating maneuvers. Such brakes are too small in size, they slope downwardly, and they often have not been designed to withstand the forces which would be placed on the brake during skating or certain skating maneuvers. Thus, during such an attempt to support the foot on the skate's brake, the foot has slipped off the brake during skating and while attempting maneuvers, creating a hazardous situation.

There are several tricks that one can do on a skateboard but which have not been done, or at least have not been done as easily, on conventional or in-line skates. For example, doing 360 degree turns or spins, and multiples or divisions thereof (e.g., "180's", "360's", "720's", etc.) on the rear wheels of a skateboard are relatively easy. However, doing these tricks on the rear wheels of conventional or in-line skates has been very difficult. This is partly because prior art skates have not provided adequate place on or adjacent the skate for the skater to put his or her other foot while doing the spin. Moreover, the leverage force necessary to raise and or maintain the front wheels of the skate off the ground in order to perform the trick has been lacking since no adequate place has been provided on the skate on which to apply such force. An attempt to do such tricks or maneuvers while attempting to rest one's foot on a prior art in-line skate's brake would be unsuccessful for two reasons: first, as described above, the brakes have not been designed with the support of one's foot in mind, and hence, there would be inadequate leverage applicable to the brake in order to raise the front end of the skate, and second, the brake's pad would drag on the ground during such wheelie or spinning type tricks.

Another trick common to skaters and skateboarders is called an Ollie. A skater performs an Ollie by jumping off the ground, for example by jumping off a ramp or an elevated surface, and by lifting the skates upwardly by tucking the knees. In the past with skateboards, Ollies have been difficult because there was no means for attaching the skateboard to the skater's feet. Thus, the skater had to reach down with his or her hand and grab the board to keep it in contact with the feet until landing occurred.

Another disadvantage of prior art skates and techniques is that it has been more difficult, especially for beginners, to easily come to a complete stop when both feet have had wheels on them. Moreover, even standing still when both feet have had wheels on them has sometimes been difficult, especially on an inclined or otherwise irregular surface.

Still another disadvantage of prior art skates has involved the avoidance of obstacles, such as potholes, curbs, rocks of various sizes and the like. Sometimes it has been difficult to avoid such obstacles when both feet have had wheeled skates on them. An attempt to remove one of the skates to alleviate this problem has not been feasible since there has not been a suitable place to rest the non-skated foot during riding.

A further disadvantage of prior art skates is that beginners often have had a very difficult time using them. This is especially true while pushing off and starting motion forward. Since conventionally both feet have been retained in a wheeled skate, the instability of the whole process just being learned has been increased. Of course, this has presented certain safety hazards when learning to skate. Moreover, stopping has been difficult for beginning skaters, both on conventional and in-line prior art skates. This has been especially true on inclined or otherwise uneven skating surfaces.

SUMMARY OF THE INVENTION

In accordance with one aspect of the present invention, a foot support device for attachment to a roller skate is provided for adequately supporting a rider's foot other than the foot being skated on. The foot supported by the support device may or may not have a skate thereon. The foot support device comprises a support member that is integral with or attachable to the roller skate. Preferably, the device extends horizontally from and behind the heel of the shoe or boot of the roller skate, however, extension to either side, to the front or above the boot is also contemplated.

The foot support device of the present invention helps eliminate many of the problems associated with prior art skates. For example, when skating on a wet or otherwise moderately slippery surface, the rider can easily at his or her option skate with one skate on and one skate off, thus enabling the rider to push off with a non-skated foot and rest it on the foot support device while skating along on the skated foot. Since the present invention improves one's stability to skate with one skate on and one skate off by enabling support for the non-skated foot, a skater is more likely to and has a more realistic option to skate in this manner, especially during moderately slippery conditions, and thus the rider is more likely to avoid slippage during a push off the slippery ground. Further, more effective recovery from slippage and or loss of balance while skating is provided since a non-skated foot is made available to catch the rider and prevent a fall, as opposed to the case where a wheeled recovery foot is the only option readily available.

The advantages of the present invention which enable easier and more stable skating and recovery on moderately slippery surfaces also provide benefits in avoiding obstacles. For example, if a rider desires to sidestep or otherwise avoid a curb, pothole or other obstacle, it is often more easily accomplished by planting a non-skated foot near or on the obstacle and thereby change course or step up onto the obstacle momentarily or for a longer period of time if desired. Thus, it is apparent that the present invention improves the agility of the skater, and he or she can go places more readily without worrying about hitting obstacles. Not only is agility improved in that the skater can plant his or her foot for making a quick change in direction, but such quick changes may also be easily accomplished by simply levering the front wheels off the ground by applying downward force on the foot support device with the non-skated (or skated as the case may be) foot and spinning several or many degrees off of a straight course in order to quickly change direction. This also improves the agility of the skater.

A device in accordance with the present invention also has benefits for those just learning how to skate, such as greater stability and control while pushing off and during recovery of balance. This makes it easier for a beginning skater to push off and control his or her balance during skating.

Of course, the present invention may be utilized when both skates are secured to the rider's feet, with one or both of the skates having the foot support device thereon. In this case, the skated foot simply rests on the foot support member when desired in a manner similar to that in which a non-skated foot is supported. In either case, whether one or both skates are utilized, there is provided an effective support for the foot not being skated on at the time, a support that is adequate in size and design for resting the foot thereon without slipping off.

In accordance with another aspect of the invention, attachment of the support member of the foot supporting device to the skate is preferably accomplished by aligning holes in a vertically extending flange, or preferably flanges, integral with and extending from the horizontal support member and rigidly attaching the flange or flanges to the skate's underside frame member with the skate's axle bolts and nuts. In the case of in-line skates, for example, this is preferably accomplished by aligning slots in the vertically extending flanges with at least two of the skate's rear wheel axles and with the flanges in a laminate or sandwich relation with vertically extending portions of the underside frame or runner of the skate, and attaching the flanges extending from the support member to the underside frame of the skate with the skates's axle bolts and nuts. In this manner, the wheels of the skate are free to rotate in a plane parallel with and in between the vertically extending flanges of the support device and the vertically extending portions of the underside frame of the skate.

Providing slots in the flanges extending from the support member allows for easy alignment of the flanges with the axles of the skate and hence easy installation and removal of the foot supporting device from the skate.

In accordance with another aspect of the invention, a wheel may be selectively attached rotatably to or removed from the support device as desired by the skater. This is preferably accomplished by providing the above described flanges for attachment integral with and along the length of the support member forming a substantially channel or U-shaped cross section between the support member and the flanges, with the wheel rotatably attached on an axle extending between the flanges. Certain tricks and maneuvers are easier with the wheel off, but more stable skating is provided with the additional wheel on. For example, spinning tricks, such as 180's, 360's, etc. may be more easily accomplished upon removing the additional wheel from the support member. Since the skater's weight may be applied to the support member through the non-skated foot, the toe of the skate may be more easily levered upwardly off the ground to allow spinning as described. By replacing the wheel on the support member, more stable skating is provided as a longer wheel base is employed. Addition of the support device, with or without the additional wheel, provides a place for the skater to grab onto with the skater's hand to raise the skate in the air during skating jumping maneuvers and tricks.

In accordance with still another aspect of the invention, the selectively attachable wheel on the support device may be selectively and multi-directionally adjustable on the support device, forwardly, rearwardly, upwardly and downwardly. This is provided by slotting the flanges extending from the support member in a pattern which enables adjustment of the additional wheel to the most appropriate location relative to the support device's flanges for a given maneuver or trick to be performed. Further in accordance with this aspect of the invention, an insert member is provided which snaps into the slots of the flanges to preclude such adjustability when adjustability of the additional wheel is not desired.

In accordance with another aspect of the invention, a skateboard type apparatus, called a foot supporting skate, is provided which comprises a single foot retaining means, such as a shoe or a boot, a plurality of in-line or differently configured wheels rotatably fixed on the underside of the foot retaining means and foot supporting means extending from the foot retaining means.

In accordance with still another aspect of the invention, a conventional brake may be provided on an end of the foot supporting member furthest from the heel of the skate shoe or boot for aiding in safe stopping or slowing of the skater.

Accordingly, it is an object of the invention to provide a device for use while roller skating to support one of the skater's feet adjacent the other foot.

Another object is to provide for more stable starting, skating and stopping.

It is another object of the invention to facilitate learning how to skate by making it easier to start, stop and maintain balance.

Still another object of the invention is to enable greater efficiency and safety in starting, stopping and/or skating on moderately slippery, inclined or otherwise irregular surfaces.

It is another object of the invention to provide means for performing new and unique maneuvers and tricks on a skate or skates.

Yet another object is to provide a device in accordance with the present invention that is easily attachable to and detachable from a number of different roller skates.

BRIEF DESCRIPTION OF THE DRAWINGS

For a better understanding of the invention, its advantages and objectives, reference will now be made, by way of example, to the accompanying drawings wherein like reference characters refer to like elements and in which.

DETAILED DESCRIPTION

Figure 1:
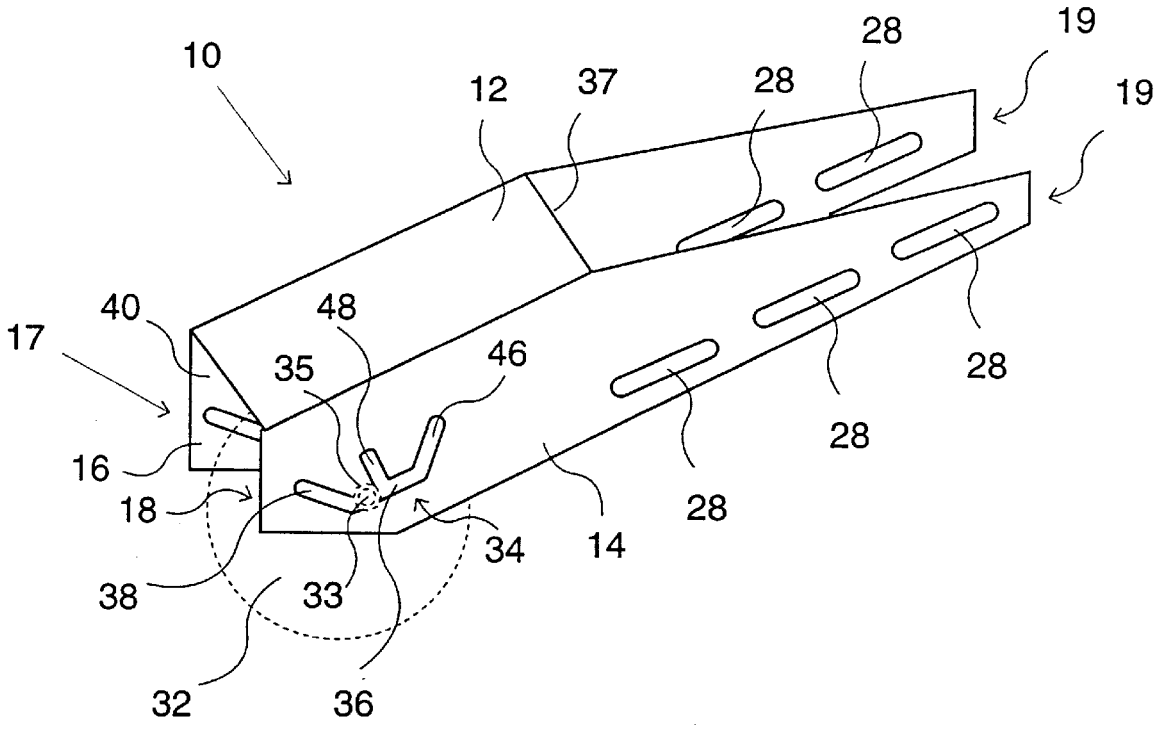
FIG. 1 is a pictorial isometric representation of a foot support device in accordance with the present invention with an optional wheel shown in phantom.
Figure 2:
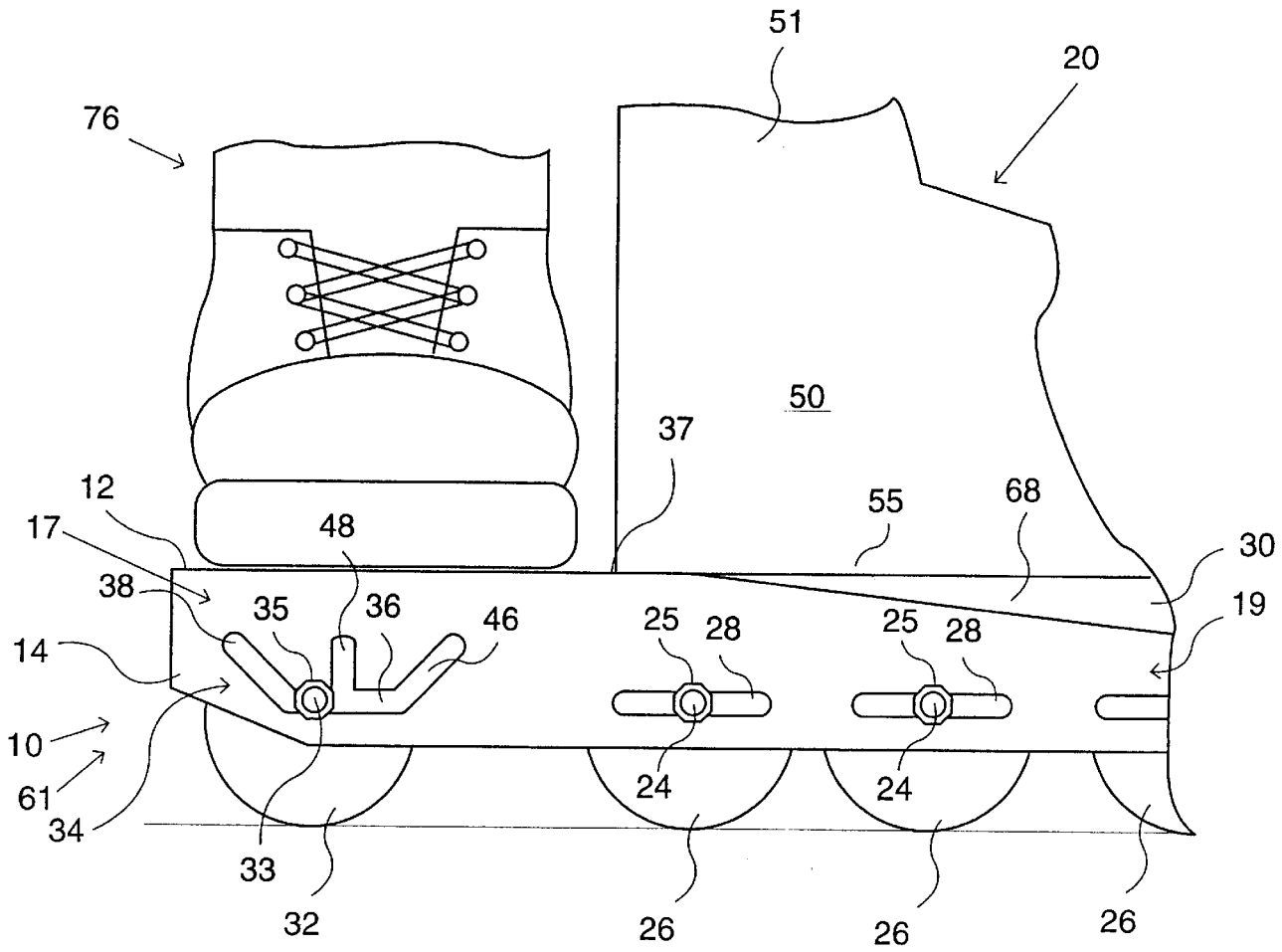
FIG. 2 is a pictorial side representation of the foot support device of FIG. 1 shown with the optional wheel and attached to the two rear axles of a partially shown in-line roller skate with a rider's non-skated foot resting on the device.

Referring to FIGS. 1 and 2, a foot support device 10 in accordance with the present invention comprises a preferably horizontally extending, rectangular support member or platform 12 with flanges 14, 16 having ends 17, 19 and inner surfaces 40, 41 (41 not shown) and such that the flanges extend vertically downwardly from the support member. Foot support device 10 is attached to a skate 20 having a boot 51 with a heel portion 50, a toe portion 53 (not shown in FIG. 2) and a sole portion 55. Support member 12 and the portions of flanges 14, 16 which extend from the skate 20 form a channel 18 which extends away, preferably longitudinally, from the skate, the channel having an up-side-down U-shaped cross section. Support member 12 and flanges 14, 16 are preferably integral and form right angles relative to each other such that flanges 14, 16 form the legs of the U-shaped channel 18 and are interconnected by support member 12. At the lowermost portion of ends 17 of flanges 14, 16, the flanges are tapered or angled upwardly towards the ends of the flanges to allow greater maneuverability during spins and wheelies such that the flanges are less likely to drag on the ground during such maneuvers. A non-slip surface may be provided on support member 12 to prevent slippage of one's foot thereon.

It will be appreciated by those of ordinary skill in the art that other support means or frame members of varying configurations, including generally U-shaped configurations and other shaped channel-type configurations, will also suffice as equivalents. Moreover, it will be appreciated by those of ordinary skill in the art that support member 12 need not be exactly horizontal with respect to the skating surface, but may also form an angle therewith, the primary and guiding factor being that it be sufficiently close to horizontal to effectively provide support for the foot during gliding and while performing tricks and other maneuvers. Thus, for example, support member 12 would preferably range in length from between three and six inches, however, slightly smaller and somewhat larger sizes are also contemplated. Further, by way of example, to achieve better clearance off the ground during wheelie or spinning maneuvers, support member 12 may be angled upwardly between zero and thirty degrees from horizontal or so.

Vertically extending flanges 14, 16 extend longitudinally beyond support member 12 and channel 18 a length sufficient to accommodate attachment of the flanges to skate 20 with two or more axle bolts 24 and nuts 25 for wheels 26 of the skate. These longitudinally extending portions of flanges 14, 16 taper downwardly from support member 12 to ends 19 to conserve material and to ensure easy attachment of foot support device 10 to any of a number of skates.

Flanges 14, 16 of foot support device 10 have a plurality of slots 28 cut therein to a size just large enough to allow axle bolts 24 to pass therethrough. Preferably, these slots 28 extend longitudinally as shown in FIGS. 1 and 2 and correspond in location to the positions of axle bolts 24 for wheels 26 along a running frame 30 of skate 20 so that the flanges 14, 16 of the foot support device 10 can be attached to the running frame of the skate with the axle bolts 24 and nuts 25. These longitudinally extending slots 28 are cut to a width just large enough to allow axle bolts 24 to pass therethrough. Such slots 28 provide for easy attachment and detachment of foot support device 10 to any of a number of different skates as well as easy adjustment of the device on a skate, since exact longitudinal alignment of circular holes with the axle locations is alleviated.

Figure 4:
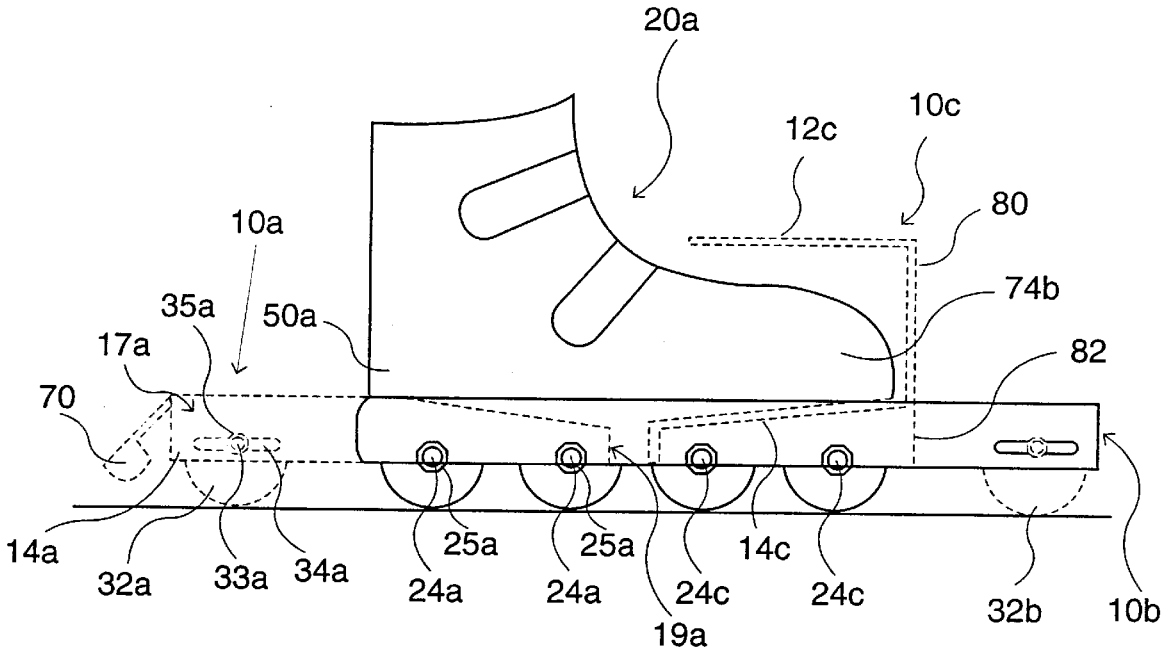
FIG. 4 is a pictorial side representation of alternative positions for a foot support device in accordance with the present invention with a rear positioning of the device being shown in phantom, and an alternative embodiment wherein the foot support device is shown in phantom positioned above a portion of the skate's boot.

Nevertheless, as shown in a slightly different embodiment of a foot support device 10*a* in accordance with the present invention shown in phantom in FIG. 4, it will be appreciated that round holes 28*a* (hidden behind nuts 25*a*) may be cut in flanges 14*a*, 16*a* (16*a* not shown) at the precise locations and sizes necessary for a custom fit on skate 20*a*. Moreover, as can be appreciated from comparing FIGS. 1, 2 and 4, differing numbers of slots 28 or holes 28*a* may be cut into flanges 14, 16 or 14*a*, 16*a* and at varying locations to allow for somewhat different but equivalent attachment methods. For example, as shown in FIGS. 1 and 2, three slots 28 are provided for attachment of the foot support device 10 with three of the axle bolts 24 and nuts 25 of in-line skate 20, whereas in FIG. 4, two holes 28*a* are provided for attachment of the foot support device 10*a* with two of the axle bolts 24*a* and nuts 25*a* of skate 20*a*.

As shown in FIGS. 1 and 2, an additional wheel slot 34 is cut in flanges 14, 16 of channel 18 of foot support device 10. Each slot 34 comprises four interconnected slots including a longitudinally extending slot 36, two angular slots 38, 46 each extending upwardly and away at an angle from each end of longitudinal slot 36, and vertical slot 48 extending perpendicularly to and upwardly from a midpoint of longitudinal slot 36. Slot 34 allows the selective attachment and detachment of an additional wheel 32 with an additional axle 33 and nut 35 to flanges 14, 16 of foot support device 10. Moreover, slot 34, which comprises slots 36, 38, 46 and 48, allows for multi-directional adjustment of additional wheel 32, upwardly and downwardly along angular slots 38, 46 and vertical slot 48, and forwardly and rearwardly along longitudinal slot 36 and angular slots 38, 46. Thus, additional wheel 32 may be adjusted in these directions as desired to allow for different tricks, maneuvers and skating stability. For example, moving additional wheel 32 rearwardly along longitudinal slot 36 would lengthen the wheel base of the skate 20 and thereby increase the stability of the skate, while adjustment of additional wheel 32 forwardly toward the heel portion 50 of the skate boot 51 along longitudinal slot 36 would shorten the wheel base but allow for certain tail tricks wherein the front end of the skate could be raised off the ground by applying leverage on the rearmost portion of foot support 12 with the skater's foot. Of course, this ability to raise the front end would be greatest without an additional wheel 32 added, and for this purpose it may be removed as indicated by showing the additional wheel in phantom in FIG. 1. If wheelie type tricks are desired, an intermediate position of additional wheel 32 may be utilized wherein it would be placed at the top of angular slot 46 or vertical slot 48. In this position, additional wheel 32 acts as a safety wheel which provides stability during wheelie type tricks and prevents the rider from pulling back too far.

Of course, it will be appreciated that other slot configurations may be imagined for slot 34 or multiple such slots may be utilized for more than one additional wheel 32, all of which would be equivalents of the present invention. For example, referring to FIG. 4, slot 34*a* is simply a longitudinal slot to allow for forward or rearward adjustment of additional wheel 32*a* attached to flanges 14*a* and 16*a* (not shown) with additional axle bolt 33*a* and nut 35*a*. Likewise, a simple vertical slot (not shown) or any of a number of other slots may be employed.

Figure 3:
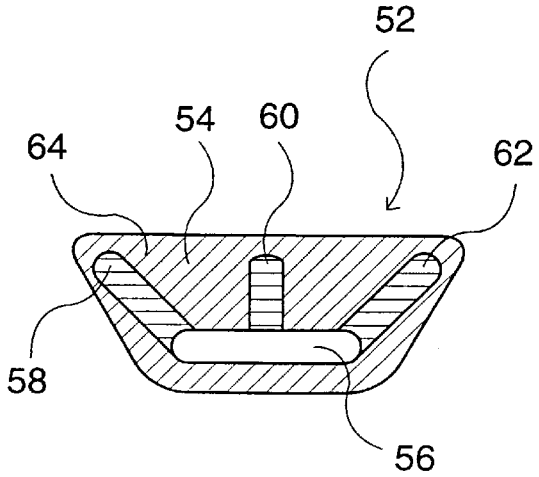
FIG. 3 is a side view of an insert in accordance with the present invention to be selectively attached or detached from the foot support device shown in FIG. 2.

Referring now to FIG. 3, there is shown an insert member 52 which is designed to fit and preferably snaps one insert member each into slots 34 shown in FIGS. 1 and 2 to preclude vertical and angular adjustability of additional wheel 32 along vertical slot 48 and angular slots 38 and 46. Preferably, each insert member 52 comprises a back piece 54 with a longitudinal slot 56 cut therein, and three slot tabs 58, 60 and 62 which protrude from the back piece to snap fit into respective slots 38, 48 and 46 in either flange 14 or 16 to allow only longitudinal adjustment of additional wheel 32 along longitudinal slot 36. Preferably, each insert member 52 is snapped into place on the inside of channel 18 with an inner surface 64 of each back piece 54 facing and engaging an inner surface 40 or 41 (not shown) of flanges 14, 16. Properly inserted, the tabs 58, 60 and 62 of insert members 52 fill slots 38, 48 and 46 in flanges 14, 16 of channel 18 such that axle bolt 33 is precluded from going into those slots, especially when the axle bolt is tightened into place with nut 35. Hence, it can be seen that insert member 52 aids in maintaining axle bolt 33 in its proper position. It will be appreciated that other insert members may be designed which will preclude and/or allow adjustability of an additional wheel in different directions along a given slot configuration. Preferably, insert member 52 is made out of a hard plastic material, however other suitable metal, fiberglass or composite materials may also be employed.

Figure 6:
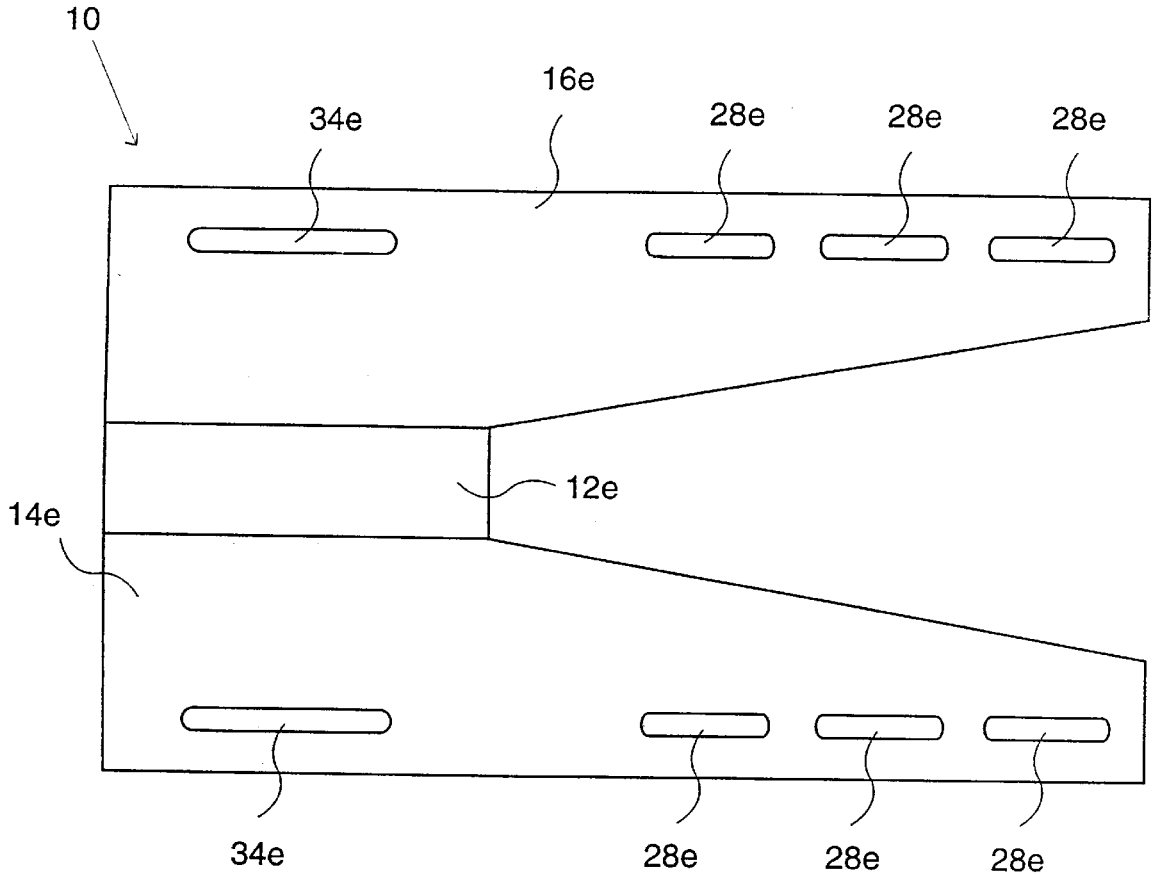
FIG. 6 is a flat map plan view of a foot support device in accordance with the present invention before bending.

Preferably, the foot support device 10 may, as an article of manufacture, be made out of a relatively thin, light weight, flat metal material, such as aluminum. However, other materials, including but not limited to plastics, fiberglass or composites, may also be used. As shown in FIG. 6, the foot support device 10 may be cut out in a flat pattern, with slots 28*e* and 34*e* cut into flanges 14*e*, 16*e*, and thereafter bent to form a foot support device with support member 12*e* in accordance with the present invention.

Preferably, foot support device 10 may be easily and selectively attached or detached from skate 20 with already existing skate axle bolts 24 and nuts 25. However, it will be appreciated by those of ordinary skill in the art that a skate with an integral extending portion similar to support member 12 may also be employed. In such a case, the frame of a skate to which a boot or shoe is attached would be extended a suitable distance, direction and angle to adequately support a skater's foot not being skated on.

Attachment of foot support device 10 is accomplished by removing the axle bolts 24 and nuts 25 of those wheels 26 necessary to accommodate alignment of holes or slots 28 in flanges 14, 16, with the axle positions of the wheels. Also, if possible, conventional braking means (not shown) which may be located near the heel portion of the skate are preferably removed before attachment of foot support device 10. If removal of any such braking means (not shown) is not possible, then use of a foot support device 10 without an additional wheel 32 is possible with the channel 18 of the foot support device fitting over the braking means, adjustment of the additional wheel 32 to its rearmost position may be possible to avoid the braking means, or a specially designed foot support device 10 may be used where the additional wheel is far enough back that it will avoid any braking means.

With the axle bolts 24 and nuts 25 removed, such that the wheels 26 fall from the running frame 30 of skate 20, the foot support device 10 is placed, in one embodiment, with an innermost edge 37 of foot support member 12 abutting heel portion 50 of boot 51 of skate 20 at the rear and lowermost portion of the heel, and such that the inner surfaces 40, 41 (41 not shown) of flanges 14, 16 and outer vertical surfaces 66 (not shown) and 68 of running frame 30 face each other and engage each other. In other words, flanges 14, 16 of foot support device 10 are just wide enough to slide over running frame 30 with a sliding fit such that the flanges and the running frames outer vertical surfaces 66, 68 touch and are in a sandwich relation with the running frame interposed between the flanges. In this position, with the innermost edge 37 of foot support member 12 abutting heel portion 50, with the flanges 14, 16 on either side of running frame 30, slots 28 are aligned with the axle positions and holes in the running frame, the wheels 26 are held in place one at a time, and the axle bolts 24 are inserted and secured with nuts 25 one at a time until all previously removed axle bolts and nuts are replaced.

In this manner, the foot support device 10 of the present invention is securely attached to the skate 20. It will be apparent to those of ordinary skill in the art that other methods of attachment of a foot support device in accordance with the present invention may be employed, either to in-line skates or more conventional skates. Thus, while the preferred embodiment is shown and described, other means of attachment such as screws, bolts, pins, nails and or adhesives, attaching the device to the sole or heel or other portion of a skate's boot or shoe may be used. Moreover, washers (not shown) and lock nuts are to be used as necessary.

Whether foot support device 10 is attached as described above or is integral with the skate, as for example when the sole of the skate boot is extended the desired distance, the resulting combination of the skate and the foot support device may be considered a new type of skateboard 61 (FIG. 2), otherwise known as a foot supporting skate, having the characteristics above and below described and with a boot, shoe or other means of securing a rider's foot thereto. Of course, this new type of skateboard 61 (foot supporting skate) may employ either in-line wheels, paired wheels on trucks or other configurations, and this in turn opens many possibilities for equivalent embodiments. It will be appreciated that though the preferred embodiment of a device in accordance with the present invention employs in-line wheels, more conventional skates or wheel configurations, with trucks, either of the locked or turning type, may be utilized with the present invention, and therefore the attachment of such wheels in different wheel configurations or with trucks to foot retaining means such as a shoe or boot in conjunction with a foot support device as above and below described shall be deemed equivalents of the present invention.

As shown in phantom in FIG. 4, conventional braking means 70 may be attached to an outermost end 14 of support member 12 of foot support device 10 for aiding in safe stopping or slowing of the skater. As with conventional brakes on in-line skates, the brake pad, which is made of rubber or other material, is dragged on the skating surface to slow the skater gradually to a stop.

Referring still to FIG. 4, foot support device 10*b* may be attached adjacent and extending from the toe portion 74*b* of skate 20*a*. In this embodiment, the conventional braking means (not shown) on the rear of the skate 20*a* near the heel portion 50*a* thereof need not be removed. However, if there is a brake adjacent the toe 74*b* of the skate 20*a*, then this may need to be removed or accommodations of the foot support device 10*b* similar to those described above in connection with the rear brake may need to be employed. As shown in phantom in FIG. 4, an additional wheel 32*b* may be employed in connection with this embodiment of the invention where the foot support device 10*b* extends from the toe portion 74*b* of the skate 20*a*.

Still further referring to FIG. 4, another embodiment of the invention is shown in phantom wherein foot support device 10*c* comprises flanges 14*c* and 16*c* (16*c* not shown) which are attached to the foremost axle bolts 24*c* of skate 20*a* in a manner similar to that shown in FIGS. 2 and 4 and as described in connection with the previously described embodiments of the invention. Preferably integral with and extending perpendicularly to and from flanges 14*c*, 16*c* (not shown), is vertically extending plate 80. Vertically extending plate 80 interconnects flanges 14*c*, 16*c* such that the flanges and the plate form a rectangular U-shaped toe piece 82 which cups the toe portion 74*b* of skate 20*a*. It will be appreciated by those of ordinary skill in the art that this U-shaped toe piece 82, which is the intersection of flanges 14*c*, 16*c* (not shown) and vertically extending plate 80, may be curved (i.e., where plate 80 is more curved and U-shaped in cross section) such that the toe piece cups toe portion 74*b* more closely. Extending rearwardly and perpendicularly from vertically extending plate 80 is foot support member 12*c* such that the foot support member is positioned directly over the toe portion 74*b* of skate 20*a* as shown. Preferably, foot support member 12*c* is integral with the rest of foot support device 10*c*.

Referring to FIG. 2, with the present foot support device 10 a method of skating is provided which comprises the steps of: pushing off the ground with one foot 76 to propel the skater along a surface, gliding along the surface on one foot retained in a first roller skate, and resting the other foot either retained or not retained in a second roller skate on a support member extending from the first roller skate while gliding along. Turning with this method of riding may be accomplished by leaning to one side or the other much as a skateboarder would turn a skateboard or a surfer would turn a surfboard. Also, with this method of skating, when an additional wheel 32 is either not utilized or when the additional wheel is moved forward sufficiently, turning may be accomplished by pressing down on the foot support device 10 with the foot not being skated on in order to raise the toe portion 74 of the skate 20 in the air such that the skater can quickly rotate on the rearmost wheel 26 to change direction. In this manner, directional control is greatly enhanced as the skater may change directions very quickly, decisively and abruptly as desired.

In conjunction with this method of riding, many variations, functions, maneuvers and tricks may be performed. For example, a skater may easily come to a stop by removing foot 76 from foot support device 10 and planting it on the skating surface to slow down and stop. Moreover, if the skating surface is uneven or on an incline, the skater can maintain his or her balance easily on the foot that may not have a skate thereon. Taking off and skating again is then performed according to the above described method. As another example, a rider may stand down on the foot support device 10 without additional wheel 32 attached thereto in order to raise or lever the front wheels of the skate 20 off the riding surface to ride a wheelie. This wheelie riding stance may be stabilized by the attachment and appropriate adjustment of additional wheel 32, which would allow the rider to skate along in the wheelie stance with relative ease. As a further example, a rider may stand down on the foot support device 10 and spin or pirouette in a circle on the rear wheel 26 of the skate 20 in a 180, 360 or other degree of spin. Still further, obstacles may be easily avoided with this method of skating as the foot resting on the foot support device 10 may be used to step up onto the obstacle, such as a curb, rail or large rock or boulder, or it may be used to plant and change course in avoidance of the obstacle.

Of course, it will be apparent to those of ordinary skill in the art that the same or similar method of riding would apply when the foot support device 10*a*, 10*b* or 10*c* is utilized. Moreover, similar or other tricks and maneuvers may be performed with these embodiments of the invention shown in FIG. 4.

Figure 5:
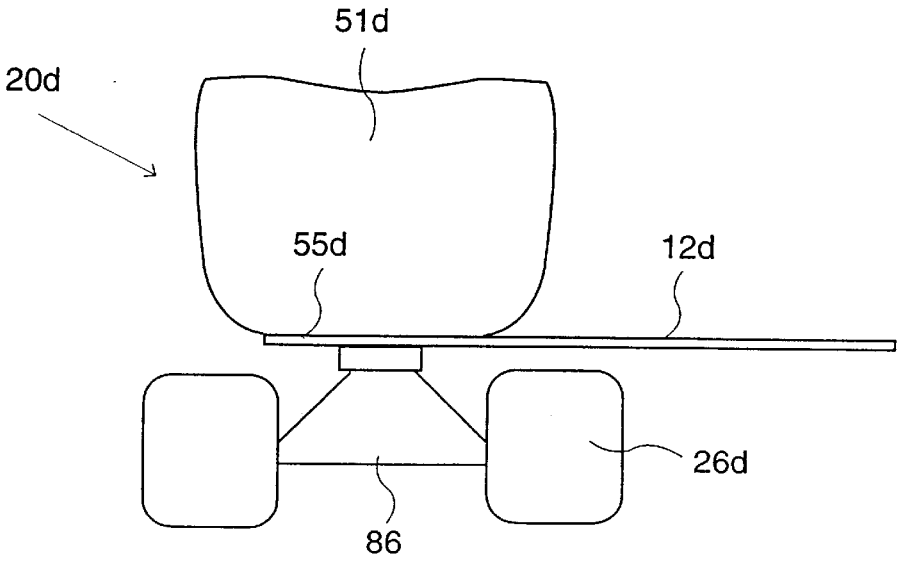
FIG. 5 is a pictorial rear representation of another alternative embodiment of a foot support device in accordance with the present invention.

Referring now to FIG. 5, another alternative embodiment of the invention is shown which comprises a foot support plate 12*d*. Preferably, foot support plate 12*d* extends outwardly horizontally to either side of boot 51*d* of skate 20*d*, depending on which foot is desired to be in the skate and which foot is desired to rest upon the foot support plate. Thus, while the foot support plate 12*d* is shown extending horizontally to the right side of left skate 20*d*, it will be appreciated that it may just as easily extend to the left side of a right foot skate or not precisely horizontally, the guiding factor being that the foot support plate be of a sufficient size and angle relative to the ground to allow adequate support of the non-skated foot during skating. Foot support plate 12*d* may extend the length of the skate boot 51*d* or it may be a peg extending from the skate or any length in between.

In this embodiment of the invention shown in FIG. 5, preferably, foot support plate 12*d* extends from and is fastened to, as with screws or bolts, the bottom of a sole portion 55*d* of boot 51*d* just above truck 86 and wheel 26*d*.

The method of riding described above applies also to this embodiment of the invention shown in FIG. 5 as well, and several of the maneuvers may be performed equally well with this embodiment of the invention. However, some of the tricks described above may not be as readily performed with this embodiment of the invention.

It will be appreciated that the present invention is not restricted to the particular embodiments that have been described and illustrated, and that variations may be made therein without departing from the scope of the invention as defined in the appended claims and equivalents thereof.

What is claimed is:

1. A foot supporting skate comprising:

foot retaining means for retaining a skater's foot, a plurality of wheels rotatable mounted to said foot retaining means, and foot supporting means extending from and to one side of said foot retaining means.

2. A foot supporting skate comprising:

foot retaining means for retaining a skater's foot, a plurality of wheels rotatably mounted to said foot retaining means, and foot supporting means extending from and positioned above said foot retaining means.

3. A foot support device adapted for attachment to a roller skate, said foot support device comprising: a foot support member having at least one flange having a plurality of longitudinally extending slots therein adapted for attaching said support member to any of a number of different roller skates.

4. A foot support device for attachment to an in-line roller skate having frame means for attaching a plurality of wheels to the in-line roller skate, the frame means having a plurality of holes therein corresponding to a plurality of wheel axle positions along the frame means, said foot support device comprising: a support member attachable to the frame means and having at least one flange having a plurality of holes therein, said flange's plurality of holes being located in said flange so as to be alienable with the plurality of holes in the frame means.

5. The foot support device of claim 4, further comprising at least one wheel rotatably attachable to said at least one flange of said support member.

6. The foot support device of claim 5, wherein said at least one wheel is adjustably attachable to said at least one flange of said support member.

7. The foot support device of claim 6, further comprising an insert member attachable to said at least one flange of said support member precluding adjustability of said at least one wheel.

8. The foot support device of claim 4, further comprising braking means on said support member for stopping and slowing a skater.

* * * * *